United States Patent [19]

Lee et al.

[11] 4,407,920

[45] Oct. 4, 1983

[54] SILICONE AMMONIUM SALTS AND PHOTORESPONSIVE DEVICES CONTAINING SAME

[75] Inventors: Lieng-Huang Lee, Webster; Deborah N. Landry, Rochester, both of N.Y.

[73] Assignee: Xerox Corporation, Stamford, Conn.

[21] Appl. No.: 360,109

[22] Filed: Mar. 19, 1982

[51] Int. Cl.[3] ..... G03G 8/00

[52] U.S. Cl. ..... 430/59; 430/66; 430/84; 430/85; 430/78

[58] Field of Search ..... 430/59, 58, 60, 66, 430/903, 63, 84, 85, 78

[56] References Cited

U.S. PATENT DOCUMENTS

| | | | |
|---|---|---|---|
| 3,986,997 | 10/1976 | Clark | 260/29.2 |
| 4,004,927 | 1/1977 | Yamamoto et al. | 96/67 |
| 4,127,697 | 11/1978 | Laurin | 428/412 |
| 4,177,175 | 12/1979 | Baney et al. | 260/29.2 |
| 4,239,668 | 12/1980 | Clark et al. | 260/29.2 |
| 4,250,240 | 2/1981 | Shimada et al. | 430/66 |
| 4,291,110 | 9/1981 | Lee | 430/63 |
| 4,317,123 | 2/1982 | Namiki et al. | 346/135 |

*Primary Examiner*—John E. Kittle
*Assistant Examiner*—John L. Goodrow
*Attorney, Agent, or Firm*—E. O. Palazzo

[57] ABSTRACT

This invention is directed to a photoresponsive device comprised of a substrate, a photoconductive composition comprised of an inorganic photoconductive composition, or a layered organic photoresponsive device comprised of a photogenerating layer and a charge transport layer, followed by an overcoating top layer of a silicone resin containing therein a silicone containing ammonium salt of the formula

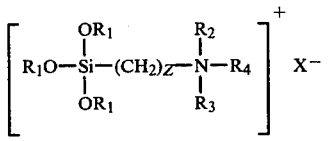

wherein, $R_1$, $R_2$, $R_3$, are independently selected from the group consisting of aliphatic and substituted aliphatic radicals, wherein the substituents include for example alkyl radicals, $R_4$ is selected from the group consisting of aliphatic radicals, substituted aliphatic radicals, and the group

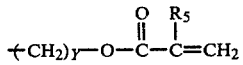

wherein Y is a number of from about 2 to about 4, and $R_5$ is hydrogen or an alkyl radical, X is an anion, and Z is a number of from 1 to about 5.

26 Claims, No Drawings

SILICONE AMMONIUM SALTS AND PHOTORESPONSIVE DEVICES CONTAINING SAME

BACKGROUND

This invention is generally directed to photoresponsive devices; and more specifically the present invention is directed to photoresponsive devices, comprised of organic or inorganic materials and silicone ammonium salts. The photoresponsive devices of the present invention are useful in electrostatographic imaging systems, particularly xerographic systems.

Overcoated photoresponsive devices containing protective top coatings, such as silicone resins are known. These protective coatings, have been found to be highly useful when applied to various organic and inorganic photosensitive materials, such as amorphous selenium. However, in many instances, these silicone resin overcoatings have a tendency to separate from the photoconductive material primarily because of their poor adhesion properties. While adhesive materials have been developed for permanently adherring top coatings such as silicone resins to photoreceptor devices, the coatings continue to separate over extended periods of usage. Additionally, it is important that adhesive materials be employed that possesses an electrical conductivity of sufficient value so as to maintain a zero to low residual potential in the photoresponsive device.

Abrasion resistant resins, such as organothiol siloxanes, and alkylene-alkoxy silane resins are disclosed in various prior art patents including U.S. Pat. Nos. 3,986,997, 4,177,175, 4,127,697, and 4,239,668. The organothiol siloxanes however, are known to suffer from a number of disadvantages. For example, these materials require high temperatures to achieve activation, and thus are of substantially little value for use at room temperatures. Additionally, in most instances, these siloxanes have undesirable odors. Further, compositions containing such siloxanes have undesirable high residual potentials when, for example, they are utilized in overcoated photoresponsive device. Also, the use of known amino silanes as adhesives or primers for photoresponsive devices, such as those disclosed in U.S. Pat. No. 4,127,697, can cause the formation of high residual potentials in these devices.

Accordingly, there continues to be a need for new adhesive materials, and particularly adhesive materials which can be utilized in photoresponsive devices for the purpose of bonding protective coatings, such as silicone resins, to the photoreceptor surface. Additionally, and more importantly there continues to be a need for adhesive materials which possess an electrical conductivity of certain valves, that is from about $10^8$ to about $10^{-}$ $(\text{ohm-cm})^{-1}$ in order that a zero to low residual potential can be maintained on the photoreceptor surface.

SUMMARY OF THE INVENTION

It is a feature of the present invention to provide photoresponsive devices containing certain silicone adhesive material which overcome the above noted disadvantages.

It is a further feature of the present invention to provide photoresponsive devices containing silicone ammonium salts as an adhesive layer.

Yet a further feature of the present invention is the provision of silicone ammonium salts, which have certain electrical conductivities, such as $10^8$ to $10^{13}$ $(\text{ohm-cm})^{-1}$, enabling these salts to be utilized in electrostatographic imaging devices for the purpose of maintaining a zero or low residual potential in such devices.

These and other features of the present invention are accomplished by the provision of photoresponsive devices containing silicone ammonium salts of the following formula:

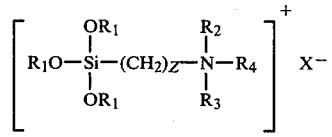

wherein, $R_1$, $R_2$, $R_3$, are independently selected from the group consisting of aliphatic and substituted aliphatic radicals, wherein the substituents include for example alkyl radicals, $R_4$ is selected from the group consisting of aliphatic radicals, substituted aliphatic radicals, and the group

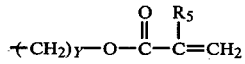

wherein Y is a number of from about 2 to about 4, and $R_5$ is hydrogen or an alkyl radical, X is an anion, and Z is a number of from 1 to about 5. In a preferred embodiment of the present invention, $R_1$, $R_2$, $R_3$ are the alkyl radicals methyl, $R_4$ is an alkyl radical, or

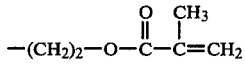

X is chloride, and Z is one. Photoresponsive devices containing the salts of the present invention are overcoated with silicone polymers as illustrated herein.

Illustrative examples of aliphatic radicals include alkyl radicals containing from about 1 to about 20 carbon atoms and preferably from about 1 to about 10 carbon atoms, such as methyl, ethyl, propyl, butyl, pentyl, hexyl, heptyl, octyl, nonyl, decyl, pentadecyl, and eiocyl. Preferred alkyl radicals include methyl, ethyl, propyl and butyl. The radical $R_4$ can be an alkyl group of from about 1 to about 20 carbon atoms; illustrative examples of which are as indicated hereinbefore.

Illustrative examples of the anion X include halide, such as chloride, bromide, fluoride, or iodide; sulfate, sulfite, nitrite, nitrate, propionate, acetate, formate, and the like.

Illustrative examples of specific silicone ammonium salts embraced within the present invention include the following:

1. Methacryloxyethyl dimethyl[3-trimethoxysilylpropyl] ammonium chloride believed to be of the following formula, and available from Dow Corning Chemical Company as Z-6031 silane (50 percent in diacetone alcohol)

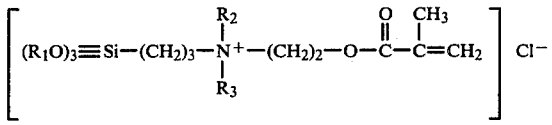

where $R_1$ $R_2$ and $R_3$ are methyl.

2. Methyacryloxy ethyl dimethyl [3-trimethoxysilyl-propyl] bromide.

3. Methacryloxy ethyl dimethyl [3-trimethoxysilyl-propyl] acetate.

4. Methacryloxy ethyl dimethyl [3-trimethoxysilyl-propyl] formate.

5. Acryloxylethyl dimethyl [3-trimethoxysilyl-propyl] ammonium chloride, believed to be of the following formula:

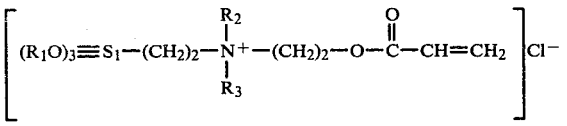

wherein $R_1$ and $R_2$ and $R_3$ are methyl.

6. Acryloxyethyl dimethyl [3-trimethoxysilyl-propyl] bromide.

7. Acryloxyethyl dimethyl [3-trimethoxysilyl-propyl] acetate.

8. Acryloxyethyl dimethyl [3-trimethoxysilyl-propyl] formate.

9. Octadecyldimethyl (3-trimethoxysilyl-propyl) ammonium chloride, believed to be of the following formula:

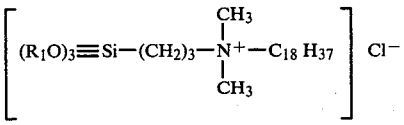

10. Octadecyl dimethyl (3-trimethoxy-silyl) propyl acetate.

11. Octadecyl dimethyl (3-trimethoxy-silyl) propyl formate.

12. Octadecyl dimethyl (3-trimethoxy-silyl) propyl bromide.

The above silicone ammonium salts can be prepared by a number of known methods including the alkylation of tertiary amines at room temperatures, or in some instances, at a temperature ranging from about 35° C. to about 100° C., in accordance for example with the following equation:

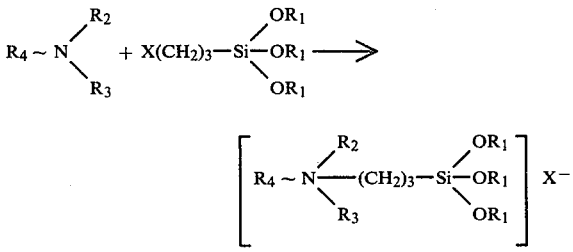

wherein $R_1$, $R_2$, $R_3$, $R_4$ and X are as defined herein.

The photoresponsive devices of the present invention include inorganic and organic compositions containing the silicone ammonium salts of the present invention. Examples of inorganic photoresponsive compositions include selenium, and selenium alloys, such as arsenic selenium, selenium tellurium, selenium antimony, as well as halogen doped selenium and halogen doped selenium alloys, and the like; which devices are overcoated with the silicone ammonium salts illustrated herein, and as a top layer an overcoating of a silicone polymer. The selenium, or selenium alloys are usually contained on a supporting substrate such as aluminum, as known in the art. In another embodiment of the present invention the silicone ammonium salts can be dispersed in the silicone polymer top coating, rather than being applied as a separate layer.

The selenium or selenium alloy layer has a thickness of from about 10 microns to about 70 microns, and preferably from about 50 microns to about 60 microns. The preferred inorganic photoresponsive material is amorphous selenium, or an amorphous selenium arsenic alloy, wherein the arsenic is present in an amount from about 0.1 percent to about 5 percent.

Illustrative examples of organic photoresponsive devices of the present invention include layered devices such as those described in U.S. Pat. No. 4,265,990, the disclosure of which is totally incorporated herein by reference, which devices are overcoated with the silicone ammonium salts illustrated herein, followed by an overcoating of a silicone resin. In such devices the silicone salts of the present invention function as adhesive material providing for the permanent binding of a silicone resin, to the photogenerating layer or the charge transport layer.

Specific examples of organic layered photoresponsive materials containing a coating of the silicone salts of the present invention, include those comprised of a substrate, a charge transporting layer, and a generating layer, as disclosed in U.S. Pat. No. 4,265,990, with the preferred transport layers being the diamines as described in the U.S. Pat. No. 4,265,990, while preferred generating layers include trigonal selenium, metal free phthalocyanines, metal phthalocyanines, and vanadyl phthalocyanine. Other organic photoresponsive materials are also included within the scope of the present invention, such as, complexes of polyvinylcarbazole with trinitrofluorenones, and the like.

The thickness of the silicone ammonium salt layer ranges from about 0.1 microns to about 3 microns, and preferably is from about 0.2 microns to about 2 microns. This layer can be of a greater or lesser thickness providing the objectives of the present invention are achieved. Thus, for example, the thickness of this layer can be as high as 2 microns or as low 0.2 microns.

As indicated herein the silicone ammonium salts employed have a specific electrical conductivity that is from about $10^8$ (ohm-cm)$^{-1}$ to about $10^{13}$ (ohm-cm)$^{-1}$ enabling the photoresponsive device to maintain a zero or low residual potential. This can be of importance since maintenance of a low residual potential will result in images of higher quality and low background, when the photoresponsive devices of the present invention are utilized in xerographic imaging systems.

Illustrative examples of the silicone resin overcoating layers for the photoresponsive devices described include various well known materials, such as, those commercially available from Dow Corning as Vestar® resins; Owens Illinois Glass resins; and the General Electric silicone hardcoatings identified as SHC-1010; and the like. This layer ranges in thickness of from about 0.5 microns to about 5 microns, and preferably from about 0.5 microns to about 2 microns.

In one preferred embodiment of the present invention there is employed a suitable substrate upon which is deposited a photogenerating layer in contact with a charge transport layer, followed by a layer of the silicone salts of the present invention, and a top coating of a silicone resin. Illustrative examples of suitable substrates include conductive substrates such as alluminum, nickel, aluminum alloys, nickel alloys, brass, and the like, as well as insulating substrates including polymers such as Mylar. The substrate when in the form of a flexible belt has a thickness of from about 100 microns to about 170 microns and preferably from about 125 to about 150 microns, while when the substrate is in a drum configuration, it has a thickness ranging from about 20 microns to about 60 microns, and preferably from about 50 microns to about 60 microns.

The silicone ammonium salts of the present invention can be applied to the photoconductive material by a number of suitable methods including for example, blade coating, dip flow coating, spraying using a suitable solvent or solvent mixture, brush coating and the like.

The photoresponsive devices of the present invention are particularly useful in xerographic imaging systems wherein an electrostatic latent image formed on the device is developed by a toner composition comprised of toner resin particles, and a colorant, followed by transferring the developed image to a suitable substrate, and fixing thereto by heat, or other suitable means, reference for example U.S. Pat. Nos. 4,265,990 and 4,251,612.

The invention will now be described in detail with respect to specific preferred embodiments, it being noted that such embodiments are intended to be illustrative only, and the invention is not intended to be necessarily limited to the conditions specified in the Examples. All parts and percentages are by weight unless otherwise indicated.

EXAMPLE I

There was prepared in a belt configuration, a photoresponsive device by vacuum depositing in a thickness of 55 microns, 105 grams of a chlorine doped arsenic selenium alloy, containing 99.64 percent by weight of selenium, and 0.36 percent by weight of arsenic, and 100 parts per million of chlorine, on a nickel surface, having a thickness of 150 microns, which nickel surface was precoated with an interface adhesive containing 80 percent by weight of a polycarbonate and a polyurethane resin mixture (80/20) in a thickness of from about 1 micron to about 2 microns.

There was then applied as an overcoating in a thickness of 0.75 microns using a one mil Bird Applicator, the silicone resin Vestar, commercially available from Dow Corning Corporation, as Vestar Q9-6503, which resin consisted of a dispersion of a silicone hybrid polymer containing 30 percent by weight of solids and water.

The overcoated photoresponsive device was then dried in an vacuum oven at 30°-35° C. for 18 hours, followed by subjecting the device to ammonia vapor for 40 minutes at room temperature, for the purpose of causing the Vestar to crosslink completely.

EXAMPLE II

The procedure of Example I was repeated with the exception that there was applied as a primer adhesive layer in a thickness of about 0.1 microns, situated between the Vestar 09-6503 overcoating, and the chlorine doped arsenic selenium alloy photoresponsive member, the silicone material SHP-200, commercially available from General Electric Corporation. The total thickness of the top layer Vestar and SHP-200 was 0.43 microns.

EXAMPLE III

There was prepared a photoresponsive device by vacuum depositing in a thickness of 55 microns, 105 grams of a chlorine doped arsenic selenium alloy containg 99.64 percent by weight of selenium, 0.36 percent by weight of arsenic, and 100 parts per million of chlorine, on a nickel surface having a thickness of 150 microns.

There was then applied as an overcoating, a silicone ammonium salt, commercially available from Dow Corning Corporation, as Z-6031 silane, a methacryloxyethyl dimethyl [3-trimethoxysilyl-propyl] ammonium chloride, (50 percent solids in a diacetone alcohol) in a thickness of 0.1 microns. Prior to applying the ammonium salt coating, there was prepared a 3 percent solution of the material as received from Dow Corning, utilizing a methanol water mixture, 4 parts by volume of methanol to 1 part by volume of water, followed by addition of acetic acid for the purpose of catalyzing the hydrolysis of the quaternary silane, and subsequently mixing the solution for 30 minutes. The ammonium salt silane is applied using a 1 mil Bird applicator. The device is then placed in a vacuum oven at room temperature for about 18 hours.

There is then applied, utilizing a 1 mil Bird applicator, a silicone resin, commercially available from Dow Corning Corporation as a Vestar 09-6503, in a thickness of about 0.60 microns, followed by drying the resulting device at 40° C. for about 12 hours in a vacuum oven.

The above device is then exposed to ammonium vapor for 40 minutes at room temperature for the purpose of completing the crosslinking of the Vestar composition.

There thus results a four layered photoresponsive device containing an aluminum substrate, overcoated with a chlorine doped arsenic selenium alloy, overcoated with a silicone quaternary ammonium salt followed by a top coating of Vestar.

EXAMPLE IV

The procedure of Example III is repeated with the exception that there is utilized as the overcoating in place of the Vestar, a silicone hard coating resin, SHC-1010, commercially available from General Electric, and situated between this top coating and the chlorine doped arsenic selenium alloy, there was applied as an adhesive primer layer the silicone resin SHP-200, commercially available from General Electric, which layer is used as a replacement for the Dow Corning silicone quaternary ammonium salt adhesive layer, the 6031 of Example III. The G.E. SHC-1010 consisted of a dispersion containing 20 percent solids in a methanol-isobutanol mixture, and prior to applying it to the photoresponsive device there was prepared a solution of this material by diluting the dispersion to 2 percent with isopropanol. While the SHP-200 G.E. primer resin as received, contained 4 percent solids in a cellulose-diacetone alcohol mixture, which mixture was diluted with acetone to 2 percent solids.

The overcoated photoresponsive device was then dried at 40° C. in a vacuum oven for about 12 hours.

The photoresponsive devices of Examples I–IV, Example III containing a silicone ammonium salt of the present invention were subjected to adhesion tests; and further the residual potential in volts of the resulting device was measured utilizing an electrometer, and the results are reported in Table I that follows. The abrasion numbers reported were arrived at by utilizing a pencil hardness test, wherein pentel lead pencils having different ratings were contacted with the overcoating of the photoresponsive device by an individual containing a pencil in his hand, and a visual observation was made as to whether the overcoating was scratched. If the overcoating was scratched with a "5H" pencil for example, a "4H" pencil was used and if no scratching was noted, the photoresponsive device was given an abrasion rating of "4H".

The residual potential values in volts represents the amount of charge remaining on the photoresponsive device after exposure to light, that is, the surface potential of the device was measured with an electrometer prior to and subsequent to exposure. A low or zero residual potential is desired, since a higher potential that is greater than 30 volts adversely affects the imaging device in that the electrical properties thereof are disrupted in subsequent imaging cycles in view of the presence of such a residual potential, which potential tends to accumulte over a period of time reaching a value of 100 or more volts, causing substantial undesirable background in the final transferred developed images obtained utilizing such a photoresponsive device.

For the adhesion tape test, adhesive tape is applied to the top layer of the device, and a designation of "intact" given should coatings not adhere to tape on the physical removal of the tape from the device, while the designation "removed" signifies the removal of the coating from the device.

TABLE I

| Example | Adhesion | Curing Conditions | Thickness of of over coating (microns) | Abrasion[a] Pencil Hardness Pentel Lead Rating | Adhesion Tape Test | Residual Potential (Volts) |
|---|---|---|---|---|---|---|
| 1* | — | Vacuum Oven Overnight at 40° C. - $NH_3$ exposure 40 min. | 0.75 | HB (very soft) | Removed | 0 |
| 2* | GE SHP200 (prior art) | Vacuum Oven Overnight at 40° C. - $NH_3$ exposure 40 min. | 0.43 | 5H | Intact | 50 |
| 3* | Dow Corning Z6031 | Vacuum Oven Overnight at 40° C. - $NH_3$ exposure 40 min. | 0.61 | 5H | Intact | 0 |
| 4** | GE SHP200 (prior art) | Vacuum oven Overnight at 40° C. - $NH_3$ exposure 40 min. | 0.47 | 5H | Removed | 50–60 |

*Examples 1–3, overcoating resin is Vestar Q96503
**Example 4, overcoating resin is GE SCH1010
[a]Combined thickness of overcoating and adhesive layer As shown in Table I, not only is the photoresponsive device of Example III containing the silicone ammonium salt of the present invention substantially hard, namely a hardness of "5H" as well as having a desirable intact adhesion, but the residual potential is zero volts.

EXAMPLE V

The procedure of Example III was repeated and photoresponsive devices were prepared with the exception that there was employed in place of the chlorine doped arsenic selenium alloy an overcoated photoresponsive device consisting of an aluminium substrate, a transport layer in a thickness of 25 microns, and containing 35 percent by weight of N,N'-diphenyl-N,N'-bis[3-methylphenyl]-1,1'-biphenyl-4,4'-diamine dispersed in a polycarbonate resin commercially available as Lexan, in contact with the aluminum substrate, a photogenerating layer 0.8 microns in thickness, containing 30 percent by weight of vanadyl phthalocyanine dispersed in a polyester resin commercially available from Goodyear as PE-100, in contact with the transport layer, and a top layer 1 micron in thickness of the chlorine doped selenium arsenic alloy of Example I.

The resulting photoresponsive devices were then subjected to the abrasion pencil hardness tests, adhesion tests of Example IV, and the residual potential of the device was measured on an electrometer, with the following results as illustrated in Table II.

TABLE II

| Overcoating Thickness Microns | Curing Conditions | Abrasion Pencil Hardness Pentel Lead Rating | Adhesion Tape Test | Residual Potential (Volts) |
|---|---|---|---|---|
| 3 | oven-120° C. 1 hour | 2H | Intact. | 13 |
| 4 | oven-120° C. 1 hour | 2H | Intact. | 30 |

The photoresponsive devices of Examples I–V were utilized to form electrostatic latent images by incorporating such devices in a Xerox Corporation experimental flat plate copying apparatus and images of excellent quality and superior resolution were obtained with the photoresponsive devices of Examples III and V. While acceptable images were obtained with the photoresponsive devices of Examples I, II, and IV, it was noted that the resulting images after development with a developer composition comprised of toner particles and carrier particles, contained high background areas. This high background was believed due to the high residual potential contained on these plates after the first imaging cycle.

Curing catalysts in addition to ammonia that can be employed for the low temperature curing of the silicone top coatings, such as the Vestar of Example I, include (1) sodium acetate, sodium formate, sodium proprionate, lithium acetate, lithium formate, lithium proprionate, potassium acetate, potassium proprionate, and the like, (2) The following quaternary ammonium bases wherein $R_1$, $R_2$, $R_3$ and $R_4$ are aliphatic or aromatic radicals:

Hydroxides:

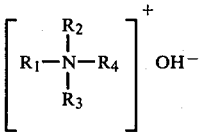

or alkoxides:

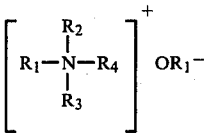

Specific examples of which include:
(a) N-benzyl-N,N,N,-trimethyl ammonium hydroxide
(b) N-benzyl-N,N,N-trimethyl ammonium methoxide
(3) Other ammonium salts; such as those of the formula wherein $R_1$, $R_2$, $R_3$ and $R_4$ are aliphatic or aromatic radicals:

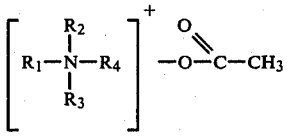

such as N-benzyl-N,N,N-trimethyl ammonium acetate.

Other modifications of the present invention will occur to those skilled in the art by the reading of the present disclosure. These are intended to be within the scope of the present invention.

We claim:

1. An improved photoresponsive device consisting essentially of a substrate, a photoconductive composition comprised of an inorganic photoconductive composition, or a layered organic photoresponsive device comprised of a photogenerating layer and a charge transport layer, followed by an overcoating top layer of a silicone resin containing therein as an adhesive layer a silicone containing ammonium salt of the formula

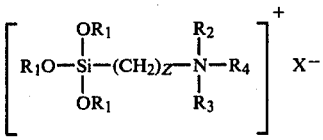

wherein, $R_1$, $R_2$, $R_3$, are independently selected from the group consisting of aliphatic and substituted aliphatic radicals, $R_4$ is selected from the group consisting of aliphatic radicals, substituted aliphatic radicals, and the group

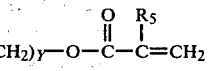

wherein Y is anumber of from about 2 to about 4, and $R_5$ is hydrogen or an alkyl radical, X is an anion, and Z is a number of from 1 to about 5.

2. A photoresponsive device in accordance with claim 1 wherein the silicone containing ammonium salt is present as a separate layer situated between the silicone resin top coating and the inorganic photoconductive composition.

3. A photoresponsive device in accordance with claim 1 wherein $R_1$, $R_2$, $R_3$ and $R_4$ are alkyl radicals containing from about 1 to about 6 carbon atoms, X is halogen, and y is 3.

4. A photoresponsive device in accordance with claim 1 wherein $R_1$, $R_2$, $R_3$ and $R_4$ are methyl, X is chloride, and y is 3.

5. A photoresponsive device in accordance with claim 1 wherein the silicone containing ammonium salt is methacryloxy ethyl dimethyl [3-trimethoxy silyl propyl] ammonium chloride.

6. A photoresponsive device in accordance with claim 1 wherein the silicone containing ammonium salt is methacryloxy ethyl dimethyl [3-trimethoxy silyl propyl] acetate.

7. A photoresponsive device in accordance with claim 1 wherein the silicone containing ammonium salt is methacryloxy ethyl dimethyl [3-trimethoxy silyl propyl] formate.

8. A photoresponsive device in accordance with claim 1 wherein the silicone containing ammonium salt is methacryloxy ethyl dimethyl [3-trimethoxy silyl propyl] bromide.

9. A photoresponsive device in accordance with claim 1 wherein the silicone containing ammonium salt is methacryloxy ethyl dimethyl [3-trimethoxy silyl propyl] chloride.

10. A photoresponsive device in accordance with claim 1 wherein the silicone containing ammonium salt is acryloxy ethyl dimethyl [3-trimethoxy silyl propyl] ammonium chloride.

11. A photoresponsive device in accordance with claim 1 wherein the silicone containing ammonium salt is acryloxy ethyl dimethyl [3-trimethoxy silyl propyl] acetate.

12. A photoresponsive device in accordance with claim 1 wherein the silicone containing ammonium salt is acryloxy ethyl dimethyl [3-trimethoxy silyl propyl] formate.

13. A photoresponsive device in accordance with claim 1 wherein the silicone containing ammonium salt is acryloxy ethyl dimethyl [3-trimethoxy silyl propyl] bromide.

14. A photoresponsive device in accordance with claim 1 wherein the silicone containing ammonium salt is acryloxy ethyl dimethyl [3-trimethoxy silyl propyl] chloride.

15. A photoresponsive device in accordance with claim 1 wherein the silicone containing ammonium salt is acryloxy ethyl dimethyl [3-trimethoxy silyl propyl] acetate.

16. A photoresponsive device in accordance with claim 1 wherein $R_1$, $R_2$, $R_3$, and $R_4$ are ethyl, X is chloride, and Y is the number 3.

17. A photoresponsive device in accordance with claim 1 wherein the inorganic photoconductive composition is comprised of amorphous selenium.

18. A photoresponsive device in accordance with claim 1 wherein the inorganic photoconductive composition is comprised of an amorphous selenium alloy.

19. A photoresponsive device in accordance with claim 1 wherein the selenium alloy is an arsenic selenium alloy, a selenium tellurium alloy, a halogen doped selenium substance, or a halogen doped selenium alloy.

20. A photoresponsive device in accordance with claim 19 wherein the halogen is chlorine.

21. A photoresponsive device in accordance with claim 1 wherein the organic photoconductive composition is comprised of a generating layer containing vanadyl phthalocyanine or triganal selenium, and the transport layer is comprised of N,N'-diphenyl-N,N'-bis(3-methylphenyl)1,1'-biphenyl-4,4'-diamine dispersed in a polycarbonate resin.

22. A photoresponsive device in accordance with claim 21 wherein the charge transport layer is in contact with an aluminum substrate and the photogenerating layer is the top layer in contact with the transport layer.

23. A photoresponsive device in accordance with claim 1 wherein the layered organic photoresponsive device is comprised of a transport layer, a photogenerating layer in contact therewith, and as a top layer a halogen doped selenium alloy.

24. An improved photoresponsive device in accordance with claim 1 wherein the resulting device has a residual potential of substantially zero.

25. An improved photoresponsive device in accordance with claim 22 wherein the silicone containing ammonium salt is present as a separate layer situated between the silicone top coating and the transport layer.

26. An improved photoresponsive device in accordance with claim 1 wherein the residual potential of the resulting device ranges from about 13 volts to about 30 volts.

* * * * *